United States Patent [19]

Borst et al.

[11] Patent Number: 4,882,027

[45] Date of Patent: Nov. 21, 1989

[54] CATHODE HANGERS

[75] Inventors: Nico Borst, Connaught; Marc D. Talbot; James D. Scott, both of Timmins, all of Canada

[73] Assignee: Kidd Creek Mines Ltd., Toronto, Canada

[21] Appl. No.: 11,949

[22] Filed: Feb. 6, 1987

[30] Foreign Application Priority Data

Feb. 6, 1986 [CA] Canada ..... 501300

[51] Int. Cl.[4] ..... C25C 7/02

[52] U.S. Cl. ..... 204/286; 204/106; 204/288; 204/290 R; 204/292

[58] Field of Search ..... 204/106, 280, 286, 288, 204/289, 292, 290 R

[56] References Cited

U.S. PATENT DOCUMENTS 4,014,763 3/1977 Lowe ..... 204/286

FOREIGN PATENT DOCUMENTS 0910844 9/1972 Canada .
0936835 11/1973 Canada .
1150669 7/1983 Canada .
2040311 8/1980 United Kingdom ..... 204/256

*Primary Examiner*—John F. Niebling
*Assistant Examiner*—Kathryn Gorgos
*Attorney, Agent, or Firm*—Arne I. Fors; Robert F. Delbridge

[57] ABSTRACT

A cathode for electrolytic refining or electro-winning of copper is disclosed. The cathode comprises a steel hanger bar having a copper cladding and a flat stainless steel starter sheet with a plurality of lugs formed along its upper edge secured to the hanger bar. Alternating lugs are bent, in opposite directions to abut and engage the side faces of the copper-clad hanger bar and are welded to the copper cladding. The lugs can be welded to the bar upper face or to the bar side faces and may have a stainless steel strip explosion bonded to the copper cladding interposed between the lugs and the copper cladding for welding of the lugs to the stainless steel strip.

6 Claims, 2 Drawing Sheets

42
33
2
10
20
46
2
18
44
48
16

30
37
34
32
44
14
26
18
20
38
28
12
40
24
22
16

30
34
33
36
32
20
26
28
14
12
18
38
40
24
22
16

CATHODE HANGERS

BACKGROUND OF THE INVENTION

This invention relates to cathode for use in the electrolytic recovery of copper and, more particularly, relates to cathode starter sheets formed of stainless steel for electrorefining or electrowinning of copper.

The use of the cathodic stainless steel starter sheets as a replacement for thin sheets of high purity copper in the electrolytic recovery of copper is described in Canadian Pat. No. 910844 issued Sept. 26, 1972. The starter sheets are secured to hanger bars by means of mechanical fasteners such as bolts or rivets which pass through lugs formed at the top of the sheets. Mechanical fasteners however are prone to corrosion and may provide poor electrical conductivity between cathode components.

Canadian Pat. No. 936835 issued Nov. 13, 1973, which relates to a cathode similar in structure to the cathode shown in Canadian Pat. No. 910844, discloses shrink-fitted corrosion-resistant insulating material enveloping the vertical side edge of the cathode plate.

A stainless steel starter sheet is also disclosed in Canadian Pat. No. 1150669 issued July 26, 1983. This patent discloses a stainless steel starter sheet welded by its upper edge to the underside of a stainless steel hanger bar.

Conventional electrorefining and electrowinning plants which use copper starter sheets have an existing supply of iron hanger bars. In that stainless steel starter sheets are not easily welded to iron, mild steel or copper-clad bars, however, it normally is not practicable to use existing bars in a conversion to a stainless steel starter sheet system.

Welding of stainless steel to copper clad iron hanger bars by conventional use of monel, inconel or copper (1% tin) as filler material has not proven successful. Both monel and copper (1% tin) welds exhibit excessive corrosion in the electrolyte and inconel welds cause deformation of the hanger bar and perforation of copper cladding to expose the core metal.

It is an object of the present invention, therefore, to provide a novel re-usable cathode starter sheet of stainless steel joined to a copper clad iron hanger bar thereby permitting retrofit and use of existing iron hanger bars with substantial savings.

It is another object of the present invention to provide a method of welding stainless steel starter sheets to copper clad iron hanger bars whereby the hanger bars are not deformed by twisting or bending during the welding operation so that the starter sheets will be suspended vertically from the hanger bars.

A further object of the present invention is the provision of a cathode structure which provides good mechanical connection between the stainless steel starter sheets and copper clad hanger bars to enhance weldability of the starter sheets to the hanger bars and to provide optimum electrical contact therebetween.

STATEMENT OF THE INVENTION

In its broad aspect, the cathode of the present invention for use in electrorefining or electrowinning of copper comprises a steel hanger bar having a rectangular cross-section with flat upper and lower surfaces and flat opposite side surfaces, a copper cladding enveloping said hanger bar, said hanger bar having end portions adapted to be seated on electrical contacts, a flat stainless steel starter sheet having an upper edge with plurality of lugs formed along said upper edge, alternate lugs along said upper edge being bent outwardly in opposite dirctions and upwardly to abut and engage opposite side faces of the copper clad hanger bar, said lugs being welded to the copper cladding whereby said stainless steel starter sheet is rigidly secured to the hanger bar substantially perpendicular to and centrally aligned with the hanger bar lower surface.

In a preferred embodiment of the invention, the stainless steel lugs are bent inwardly at their upper distal ends to overlap the upper face of the copper clad hanger bar for welding to the copper cladding on said bar upper face.

In another embodiment of the invention, the lugs are welded to the side faces of the copper clad hanger bar.

In either of the aforementioned embodiments of the invention, a stainless steel strip may be interposed between the alternating lugs and the copper clad hanger bar, said stainless steel strip being explosion bonded to the copper cladding and the stainless steel lugs being welded to the stainless steel strip.

A copper wire or rod containing, by weight, 3.43% Si, 1.0% Mn and 0.17% Fe has been found to provide a good filler metal for securing the stainless steel lugs to the copper cladding.

The invention will now be described in detail with reference to the accompanying drawings, in which:

DESCRIPTION OF THE PREFERRED EMBODIMENTS

Figure 1:
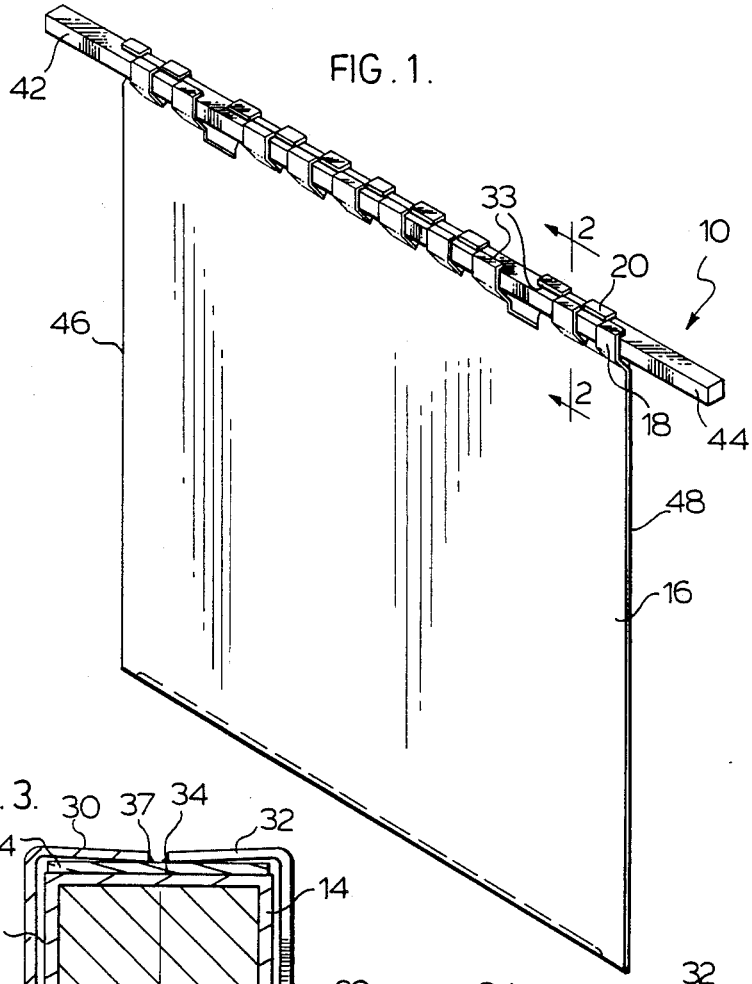
FIG. 1 is a perspective view of a preferred embodiment of the cathode of the present invention.
Figure 2:
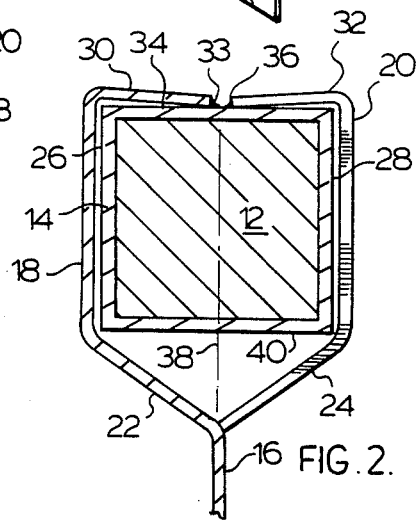
FIG. 2 is a section taken along 2—2 of FIG. 1.

With reference to FIGS. 1 and 2, the embodiment of the stainless steel cathode illustrated therein comprises a hanger bar 10 having an iron or mild steel core 12 with a copper cladding 14 tightly enveloping or bonded to core 12 from one end of the bar to the other. Copper cladding 14 preferably has a thickness in the range of about 2 mm to about 4 mm, preferably about 3 mm.

An austenitic stainless steel plate or starter sheet 16 preferably formed of 316L stainless steel has a plurality of oppositely bent lugs 18, 20 formed along its upper edge initially diverging upwardly and outwardly at 22, 24 and then extending parallel to the plane of the sheet 16 close to or abutting side faces 26, 28 of copper clad hanger bar 10 to receive bar 10 therebetween. The free or distal ends 30, 32 of lugs 18, 20 are bent inwardly through at least about 90°, preferably about 93°, for alignment of the terminus 33 of each lug substantially with the center line of the upper face 34 of hanger bar 10 for welding of said edges to the copper cladding, as depicted most clearly in FIG. 2 by fillet welds 36. Sheet 16 thus is mechanically supported by the distal ends 30, 32 of lugs 18, 20 which bear on upper surface 36 of hanger bar 10 and are rigidly secured thereto by the welds 36 to ensure good electrical conductivity and to ensure that the vertical plane of sheet 16 is in alignment with the vertical center line of the hanger bar, depicted by numeral 38, and is maintained perpendicular to the under surface 40 of the said hanger bar.

The opposite ends 42, 44 of hanger bar 10 extend laterally beyond the side edges 46, 48 of sheet 16 to permit seating of the hanger bar 10 on electrical support contacts in an electrowinning or electrofining cell, well known in the art and not shown.

Figure 3:
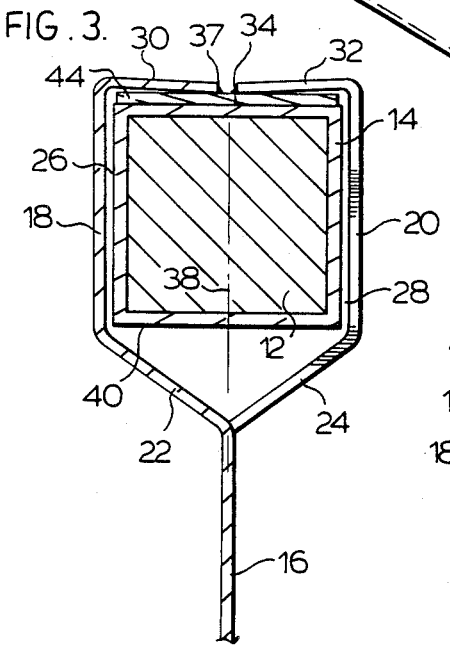
FIG. 3 is a section of an alternate embodiment taken along 2—2 of FIG. 1.

FIG. 3 illustrates another embodiment of the invention shown in FIG. 1 wherein an intermediary stainless steel strip 44 is interposed between distal ends 30, 32 of lugs 18, 20 and the upper surface 34 of hanger bar 10 along the length thereof. Strip 44 preferably is explosion bonded to the copper cladding enveloping bar 10 to provide a good electrical and mechanical contact between strip 44 and the bar 10. The distal ends 30, 32 of lugs 18, 20 would, therefore, be welded to strip 44 by fillet welds 37, thus facilitating the effective welding of the sheet to the hanger bar.

Figure 4:
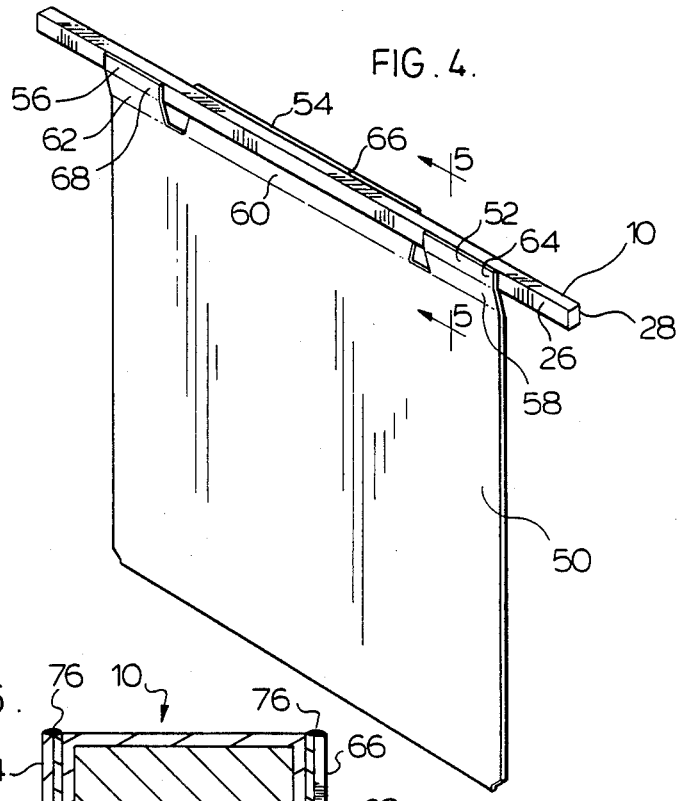
FIG. 4 is a perspective view of another embodiment of the present invention.
Figure 6:
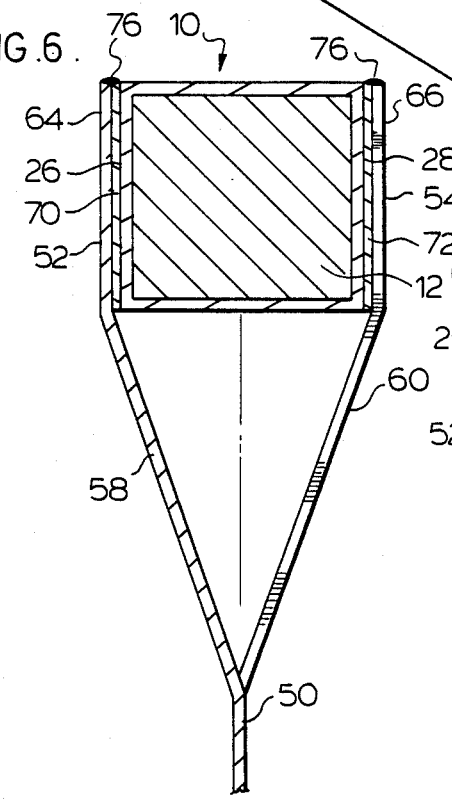
FIG. 6 is a section of an alternate embodiment taken along 5—5 of FIG. 4.
Figure 5:
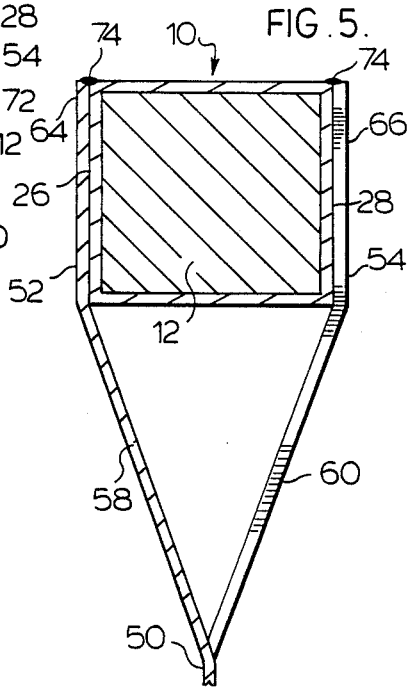
FIG. 5 is a section taken along 5—5 of FIG. 4.

FIG. 4 illustrates another embodiment of our invention in which copper clad hanger bar 10 has a stainless steel sheet 50 secured thereto by means of lugs 52, 54 and 56 welded to the opposite side faces 26, 28 of the hanger bar, as shown more clearly in FIG. 5. Lugs 52, 54 and 56 have outwardly diverging oppositely inclined portions 58, 60 and 62, respectively terminating in distal portions 64, 66 and 68 which are parallel to and closely about the opposite side faces 26, 28 of the hanger bar 10 for welding directly thereto by welds depicted by numeral 74 or for welding to intermediary stainless steel strips 70, 72 interposed between the lugs and the side faces as shown in FIG. 6. Stainless steel strips 70, 72 preferably are explosion bonded to the side faces 26, 28 of the hanger bar to provide good electrical and mechanical contact therewith and to facilitate welding of the lugs to the hanger bar by welds depicted by numeral 76.

It has been found that low-temperature welds 36, 37 in the embodiments of FIG. 1 and welds 74, 76 in the embodiments of FIG. 4 can be made without warping or bending of the hanger bars and without perforation of the copper cladding by use of high silicon copper such as LINDE 26 (Trade Mark) filler wire having, by weight, 3.43% Si, 1.00% Mn and 0.17% Fe, the balance Cu. Welding wire having a diameter not greater than about 0.05 inches, preferably about 0.035 inches, applied by MIG arc welding under 100% argon shielding gas at 1.13 Cubic meters/hr applying 230 amperes at 27 volts (+ or −5%) by a pulse power supply using a ESAB LAK Pulse-Arc 350 (Trade Mark) machine with wire feed at 285 mm/sec (+ or −10%) provided suprisingly good welds which were corrosion-resistant in the electrolyte. The hanger bars were rigidly clamped at each end during welding and were substantially free of bending or twisting with flat stainless steel sheets secured thereto after completion of the welding operation.

It is believed the use of staggered lugs allowed possible distortion in the sheets due to expansion, notwithstanding the selection of relatively low-temperature filler metal, to be oriented in opposite directions along the top of the blank and thus be effectively cancelled. The embodiments of FIG. 1 which have about 20 "opposed" lugs bent over the hanger bar were particularly resistant to distortion, the 3° angle of the lug to the plane of the upper bar surface obviating torsional deformity of the stainless steel sheet.

The present invention provides a number of important advantages. Steel or iron hanger bars can be used with stainless steel starter sheets by means of copper cladding the hanger bars and employing a novel sheet hanger configuration in combination with welds using copper-silicon filler metal to provide a warp-free structure which hangs vertically in electrorefining or electrowinning cells. Electrical conductivity and mechanical integrity of the resulting cathode structures are satisfactory and provide efficient electrolytic recovery of metal.

It will be understood, of course, that modifications can be made in the embodiments of the invention illustrated and described herein without departing from the scope and purview of the invention as defined by the appended claims.

The embodiments of the invention in which an exclusive property or privilege is claimed are defined as follows:

1. A cathode for use in electrolytic refining or electrowinning of copper, comprising: a mild steel or iron hanger bar having a rectangular cross-section providing flat upper and lower surfaces and flat opposite side surfaces; a copper cladding enveloping said hanger bar; said hanger bar having end portions adapted to be seated on electrical contacts; a flat stainless steel starter sheet having an upper edge with a plurality of lugs formed along said upper edge, alternating lugs along said upper edge being bent in opposite directions to abut and engage opposite side faces of the copper-clad hanger bar, said stainless steel lugs being welded to the copper cladding by high silicon copper wire whereby said stainless steel starter sheet is rigidly secured to the hanger bar substantially perpendicular to and centrally aligned with the hanger bar lower surface.

2. A cathode as claimed in claim 1 wherein said alternating lugs are bent inwardly to overlap the copper-clad hanger bar upper face and the lugs are welded to the copper cladding on said bar upper face.

3. A cathode as claimed in claim 2 wherein said lugs are bent inwardly through about 93° whereby the lugs define an angle of about 3° to the hanger bar flat upper surface.

4. A cathode as claimed in claim 1 wherein said alternating lugs are welded to the opposite side faces of the copper-clad hanger bar.

5. A cathode as claimed in claim 2, 3 or 4 wherein said stainless steel lugs are welded to the copper cladding using high silicon copper wire containing by weight 3.43% Si, 1.0% Mn and 0.17% Fe, the balance copper.

6. A cathode as claimed in claim 1, 2 or 4 wherein at least one stainless steel strip is interposed between the alternating lugs and the copper-clad hanger bar, said stainless steel strip being explosion bonded to the copper cladding and the stainless steel lugs being welded to the stainless steel strip.

* * * * *